US005930566A

United States Patent [19]

Ishiyama

[11] Patent Number: 5,930,566

[45] Date of Patent: Jul. 27, 1999

[54] ELECTROSTATIC CHARGING APPARATUS HAVING CONDUCTIVE PARTICLES WITH A MULTI-PEAKED SIZE DISTRIBUTION

[75] Inventor: Harumi Ishiyama, Numazu, Japan

[73] Assignee: Canon Kabushiki Kaisha, Tokyo, Japan

[21] Appl. No.: 08/848,288

[22] Filed: Apr. 29, 1997

[30] Foreign Application Priority Data

May 2, 1996 [JP] Japan ..... 8-111551

[51] Int. Cl.[6] ..... G03G 15/02

[52] U.S. Cl. ..... 399/168; 399/174

[58] Field of Search ..... 399/168, 174, 399/175, 176; 361/225, 214, 220–222

[56] References Cited

U.S. PATENT DOCUMENTS

| | | | |
|---|---|---|---|
| 5,158,852 | 10/1992 | Sakata et al. | 430/106.6 |
| 5,606,401 | 2/1997 | Yano | 399/175 |
| 5,659,852 | 8/1997 | Chigono et al. | 399/175 |

FOREIGN PATENT DOCUMENTS

| | | |
|---|---|---|
| 0 689 102 | 12/1995 | European Pat. Off. . |
| 1-219770 | 9/1989 | Japan . |
| 6-313985 | 11/1994 | Japan . |
| 8-050394 | 2/1996 | Japan . |
| 8-069149 | 3/1996 | Japan . |

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

A charging apparatus is disclosed which has an object member and a charging member. The charging member has magnetic particles, provided in contact with the object member and capable of electrostatically charging the object member upon application of a voltage. The surfaces of the magnetic particles are formed of a composite which includes conductive particles and a binder resin, and the conductive particles are in a proportion of from 80% by weight to 99% by weight in total weight based on the weight of the composite. The conductive particles have a size distribution having at least two peaks or shoulders. Also, an electrophotographic apparatus having the charging member is disclosed.

24 Claims, 7 Drawing Sheets

ELECTROSTATIC CHARGING APPARATUS HAVING CONDUCTIVE PARTICLES WITH A MULTI-PEAKED SIZE DISTRIBUTION

BACKGROUND OF THE INVENTION

1. Field of the Invention

This invention relates to an electrophotographic apparatus such as a copying machine and a printer, and a charging apparatus used therein. More particularly, it relates to an electrophotographic apparatus in which a charging member is brought into contact with a photosensitive member to electrostatically charge the photosensitive member, and a charging apparatus.

2. Related Background Art

In charging apparatus used in electrophotography, corona charging assemblies have been used. In recent years, in place of them, contact charging assemblies are being put into practical use. The latter is intended for decreasing ozone and decreasing power consumption. In particular, roller charging systems employing a conductive roller as a charging member are preferably used in view of stability in charge.

In the roller charging, a conductive elastic roller is brought into pressure contact with an object member (e.g., photosensitive member) and a voltage is applied thereto to electrostatically charge the object member.

In the conventional contact charging, the object member is charged by the release of charges (i.e., discharging) from a charging member to the object member, and hence the charging takes place upon application of a voltage having a magnitude greater than a certain threshold voltage. For example, in an instance where a charging roller is brought into pressure contact with an OPC photosensitive member (a photosensitive member making use of an organic photoconductive material) of 25 $\mu$m in layer thickness, the surface potential of the photosensitive member begins to increase upon application of a voltage of about 640 V or higher, and at voltages higher than that the surface potential of the photosensitive member linearly increases by gradient 1 with respect to the applied voltage. Hereinafter, this threshold voltage is defined as charge starting voltage Vth.

More specifically, in order to obtain a required surface potential Vd of the photosensitive member, it is necessary to apply to the charging roller a DC voltage of Vd+Vth. The method in which only a DC voltage is applied to a contact charging member to electrostatically charge the photosensitive member by discharging is called DC charging.

In the DC charging, however, it has been difficult to keep the surface potential of the photosensitive member at the desired value because the resistance value of the contact charging member may vary depending on environmental variations and also because the Vth may vary with changes in layer thickness due to the surface scrape of the photosensitive member with its use.

Accordingly, as a proposal to achieve more uniform charging, Japanese Patent Application Laid-open No. 63-149669 discloses an AC charging system in which a voltage formed by superposing on a DC voltage corresponding to the desired Vd an AC voltage having a peak-to-peak voltage of 2×Vth or higher is applied to the contact charging member. This system aims at an effect of leveling the potential by AC voltage, where the potential of the charging member is converged into the Vd that is the center of the peak of the AC voltage and can be hardly affected by external factors such as environment.

However, even in such a contact charging apparatus, its essential charging mechanism utilizes the phenomenon of discharging from the charging member to the photosensitive member. Hence, as previously stated the voltage required for the charging has a value greater than the surface potential of the photosensitive member and ozone is also generated in a very small quantity. Also, when the AC charging is effected in order to achieve the uniform charging, the ozone may more increase in quantity, the electric field of the AC voltage causes vibration or noise of the charging member and photosensitive member, or the surface of the photosensitive member may seriously deteriorate, bringing about additional problems.

Under such circumstances, it is desired to charge the photosensitive member in the manner that charges are directly injected into it without relying on the phenomenon of discharging, and some proposals are made on such direct injection of charges, none of which, however, have not yet put into practical use. Japanese Patent Application Laid-open No. 6-3921 proposes, as a more effective charge injection method, a method in which a charge injection layer is provided on the surface of a photosensitive member and charges are directly injected into that layer by means of a contact charging member (which is called injection charging).

In the injection charging, it is effective to use as the charging member a magnetic brush roller which can be brought into contact with the photosensitive member at a greater nip between them, and which can be brought into uniform contact with the surface of the photosensitive member and can be free from microscopic incomplete charging. This is to use a charging member having the form of a magnetic brush formed using a magnet roll to magnetically confine ferrite particles or medium-resistance charged magnetic particles obtained by dispersing magnetic fine particles in a resin.

The charge injection layer serving as a surface layer of the photosensitive member may be a layer formed by dispersing conductive fine particles in an insulating and light-transmitting binder. Such a layer is preferably used. The charging magnetic brush to which a voltage is applied comes in touch with this charge injection layer, whereupon the conductive fine particles come to exist as if they are numberless independent floating electrodes with respect to the conductive support of the photosensitive member, and can be expected to have such an action that they charge the capacitor formed by these floating electrodes.

Thus, the voltage applied to the contact charging member and the surface potential of the photosensitive member are converged into values substantially equal to each other, so that a low-voltage charging method can be accomplished.

However, in the above conventional case, where conventional magnetic resin particles are used as the charging magnetic particles, the magnetic resin particles having broken during use may become buried in the photosensitive member to tend to block exposure or affect charging performance.

Accordingly, it has been attempted to make up the magnetic resin particles using a resin with a high hardness so that the magnetic resin particles can have a higher strength. However, since the conventional magnetic resin particles are produced by kneading and pulverization, the surfaces of the magnetic resin particles may be macroscopically irregular to scratch the surface of the photosensitive member.

Such macroscopically irregular surfaces of the magnetic resin particles may also make the particles have a poor fluidity to make it difficult for the magnetic resin particles to smoothly come in touch with the photosensitive member to inject charges thereinto.

Moreover, in the injection charging, the charging member must microscopically well come in touch with the photosensitive member before the charges can be well injected. However, for the magnetic resin particles produced by pulverization and having macroscopically irregular surfaces, it has been difficult to well come in touch with the surface of the photosensitive member, resulting in an insufficient charging uniformity.

Meanwhile, in the case when charging magnetic particles comprised of only ferrite or magnetite which is a metal oxide are used, they may barely break when used. However, it is very difficult to produce charging magnetic particles having uniform small particle diameters. Hence, in an attempt to achieve a good charging uniformity, a fairly high production cost may result.

In addition, in the case of charging, which is different from developing, almost no toner is present between the magnetic particles and the photosensitive member, and hence there is the problem that the magnetic particles may scratch or scrape the photosensitive member.

SUMMARY OF THE INVENTION

An object of the present invention is to provide a charging apparatus and an electrophotographic apparatus that can prevent the object member from undergoing damage such as contamination, scratches and scrape and also can achieve a uniform charging performance for a long period of time.

To achieve the above object, the present invention provides a charging apparatus comprising an object member and a charging member comprised of magnetic particles, provided in contact with the object member and capable of electrostatically charging the object member upon application of a voltage;

the surfaces of the magnetic particles being formed of a composite comprising conductive particles and a binder resin, and the conductive particles being in a proportion of from 80% by weight to 99% by weight in total weight based on the weight of the composite.

The present invention also provides an electrophotographic apparatus comprising an electrophotographic photosensitive member, a charging member comprised of magnetic particles, provided in contact with the electrophotographic photosensitive member and capable of electrostatically charging the electrophotographic photosensitive member upon application of a voltage, an exposure means, a developing means, and a transfer means;

the surfaces of the magnetic particles being formed of a composite comprising conductive particles and a binder resin, and the conductive particles being in a proportion of from 80% by weight to 99% by weight in total weight based on the weight of the composite.

DESCRIPTION OF THE PREFERRED EMBODIMENTS

Figure 1:
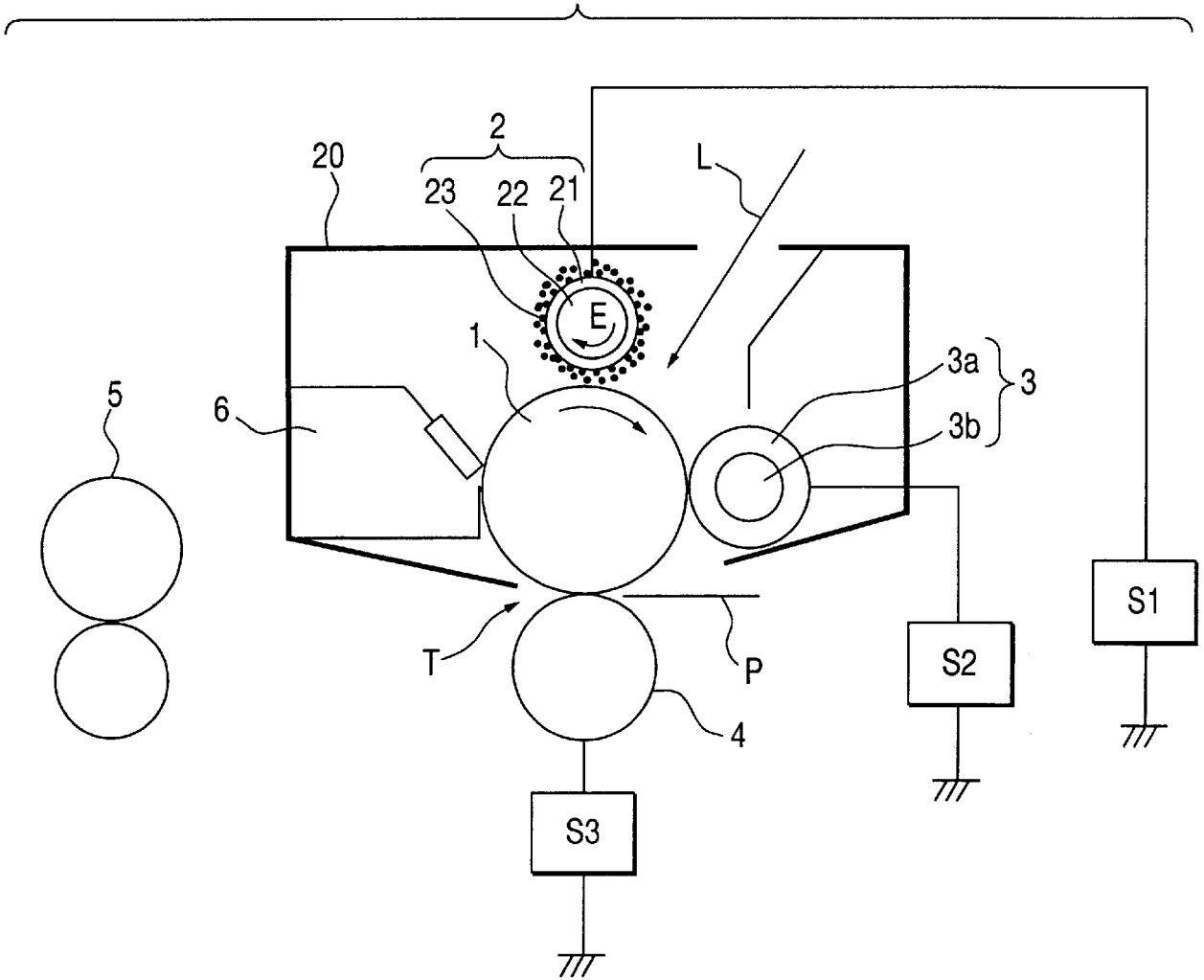
FIG. 1 schematically illustrates an example of the constitution of an electrophotographic apparatus having the charging apparatus of the present invention.

The charging apparatus of the present invention comprises an object member (a member to be charged) and a charging member comprised of magnetic particles, provided in contact with the object member and capable of electrostatically charging the object member upon application of a voltage.

In the above charging apparatus, the surfaces of the magnetic particles are formed of a composite comprising conductive particles and a binder resin, and the conductive particles are in a proportion of from 80% by weight to 99% by weight in total weight based on the weight of the composite.

The electrophotographic apparatus of the present invention has at least an electrophotographic photosensitive member, the above charging member, an exposure means, a developing means, and a transfer means.

The magnetic particles used in the present invention may preferably have particle diameters as small as possible from the viewpoint of charging uniformity. However, particles with too small diameters may cause adhesion of magnetic particles to the object member because of the relationship between magnetic force and particle diameter. From such a viewpoint, the magnetic particles may preferably have a number average particle diameter within the range of from 1 $\mu$m to 200 $\mu$m, and more preferably within the range of from 1 $\mu$m to 100 $\mu$m from the viewpoint of charging uniformity. They may still more preferably have a number average particle diameter within the range of from 5 $\mu$m to 50 $\mu$m because a better charging uniformity can be achieved and the magnetic particles may adhere to the object member with difficulty. Magnetic particles having a number average particle diameter larger than 200 $\mu$m are not preferable from the viewpoint of charging uniformity because the area in which the magnetic brush rubs the object member (photosensitive member) may become so small that no sufficient charging can be achieved and also uneven brushing may be caused by the magnetic brush. If the particles have a number average particle diameter smaller than 1 $\mu$m, the individual magnetic particles may have so small a magnetic force that the magnetic particles tend to adhere to the object member.

To measure the particle diameters of the magnetic particles used in the present invention, at least 300 particles are sampled at random by the aid of an optical microscope, and their horizontal-direction Feret's diameters are measured by means of an image processing analyzer LUZEX 3, manufactured by Nireco Co., to calculate the number average particle diameter.

With regard to resistance value of the magnetic particles, those having a too high resistance can not feed charges necessary for charging the photosensitive member to cause faulty charging, resulting in fogged images. On the other hand, those having a too low resistance may cause a drop of charging voltage because of concentration of electric currents to pinholes if the photosensitive member has pinholes in its surface portion, to cause faulty charging in the form of charging nip. From these viewpoints, the magnetic particles may preferably have a resistance value of from $1\times10^5$ to $1\times10^8$ Ω·cm.

Figure 7:
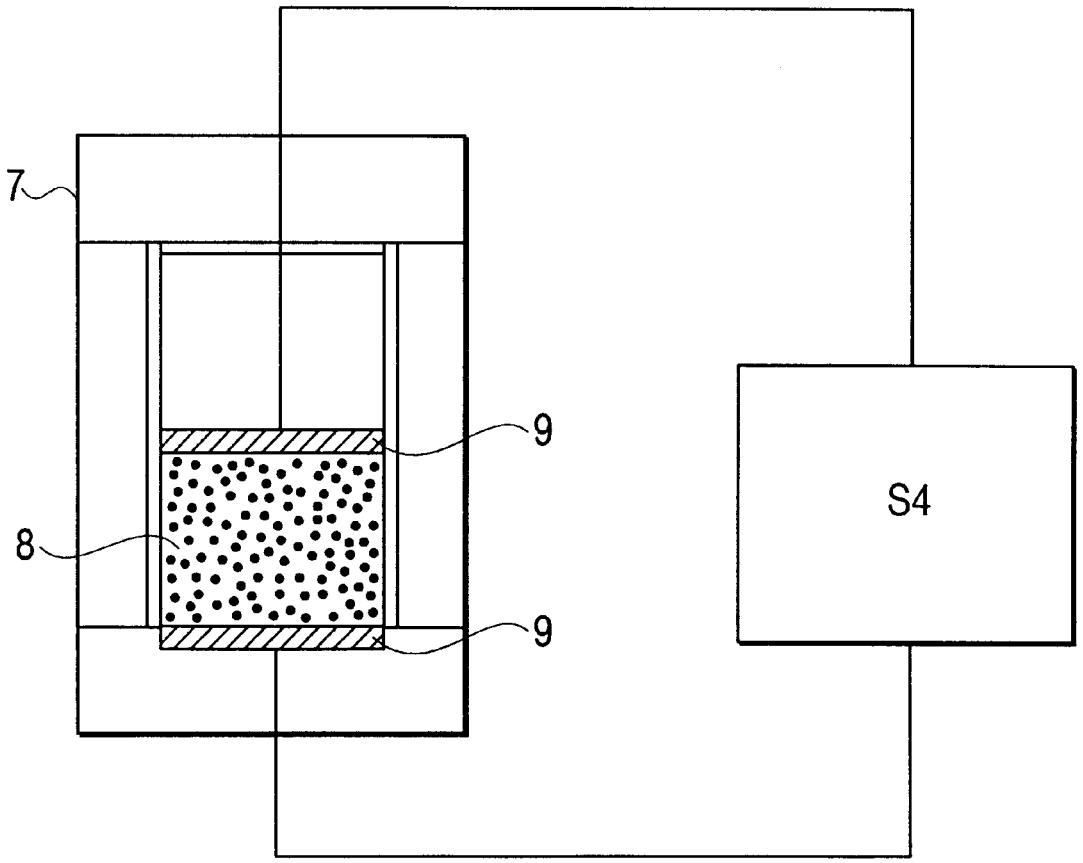
FIG. 7 diagrammatically illustrates an apparatus for measuring the resistance of magnetic particles and conductive particles.

To measure the resistance value of the magnetic particles, as shown in FIG. 7, 2 g of magnetic particles are, as denoted by reference numeral 8, put into a metallic cell 7 (bottom area: 228 $mm^2$) to which a voltage can be applied, and are then weighted at 6.6 $kg/cm^2$, followed by application of a DC voltage of 100 V through a power source S4. In FIG. 7, reference numeral 9 denotes electrodes.

The magnetic particles used in the present invention may also preferably have a sphericity of 2 or less. If their sphericity is more than 2, the magnetic particles may have a poor fluidity and can not smoothly come in touch with the photosensitive member to make it difficult to obtain uniform charging. To measure the sphericity of the magnetic particles used in the present invention, at least 300 magnetic particles are sampled at random by the aid of a field-emission scanning electron microscope S-800, manufactured by Hitachi Ltd., and their sphericity calculated from the following expression is determined by means of an image processing analyzer LUZEX 3, manufactured by Nireco Co. Sphericity $SF1=(MX\ LNG)^2/AREA\times\pi/4$ MX LNG: maximum diameter of a magnetic particle AREA: projected area of a magnetic particle Here, the closer to 1 the SF1 is, the more spherical the particle is.

With regard to magnetic characteristics of the magnetic particles, the particles may preferably have a higher magnetic force in order to prevent the magnetic particles from adhering to the object member, and may preferably have a saturation magnetization of 50 ($A\cdot m^2/kg$) or above.

To measure the magnetic characteristics in the present invention, a vibration magnetic field type magnetic characteristics automatic recorder BHV-30, manufactured by Riken Denshi K.K. is used. Values of magnetic characteristics of the magnetic particles are indicated as intensity magnetization saturated when a magnetic field of 10 kilooersted is formed.

The conductive particles contained in the composite used in the magnetic particles of the present invention may have, or not have, magnetic properties by themselves.

Conductive particles having magnetic properties may include magnetic iron compounds, and particles of metals or alloys containing iron element or particles of magnetite or ferrite represented by the general formula: $MO\cdot Fe_2O_3$ or $MFe_2O_4$ may preferably be used. Here, M represents a divalent or monovalent metal ion, Mn, Fe, Ni, Co, Cu, Mg, Zn, Cd or Li. M may be a single metal or a plurality of metals. Stated specifically, M may include silicon steel, Permalloy, Sendust, alloys such as Fe—Co and alnico, and iron oxides such as magnetite, γ-iron oxide, Mn—Zn ferrite, Ni—Zn ferrite, Mn—Mg ferrite, Li ferrite and Cu—Zn ferrite. In particular, magnetite is more preferred, as being inexpensive and not containing various metals.

Conductive particles having no magnetic properties may include particles of carbon and non-magnetic metal oxides of metals such as Mg, Al, Si, Ca, Sc, Ti, V, Cr, Mn, Fe, Co, Ni, Cu, Zn, Sr, Y, Zr, Nb, Mo, Cd, Sn, Ba and Pb which are used alone or in combination. Such metal oxides may include $Al_2O_3$, $SiO_2$, CaO, $TiO_2$, $V_2O_5$, $CrO_2$, $MnO_2$, $Fe_2O_3$, CoO, NiO, CuO, ZnO, SrO, $Y_2O_3$and $ZrO_2$. In this instance, such particles may be used together with the magnetic conductive particles as described above or non-conductive magnetic particles. As a method by which the conductivity is imparted, e.g., lattice defects may be formed by doping.

In the present invention, the conductive particle may preferably be a metal, alloy or metal oxide having magnetism in terms of the magnetic force.

Also, in the present invention, the conductive particle contained in a proportion of from 80 to 99% by weight makes it possible to form the spherical magnetic particles and also provide the particles having fine irregularities on their surfaces. Because of the presence of such fine irregularities (i.e., concaves and convexes), any deterioration during running occurs at the concaves, and the convexes are always stably present as injection points.

The concaves of the surface irregularities of the magnetic particles can be made deeper when the magnetic particles are formed by mixing large-diameter conductive particles and small-diameter conductive particles. Also, the small-diameter conductive particles serve as a reinforcing agent, and hence the strength of the particles does not lower. In order to make deeper the concaves of the surface irregularities of the magnetic particles, the magnetic particles may also be formed using only the large-diameter conductive particles. However, in such an instance, the hardness (strength) of the magnetic particles tends to be lower than the instance where the large-diameter particles and small-diameter particles are mixed.

Figure 8:
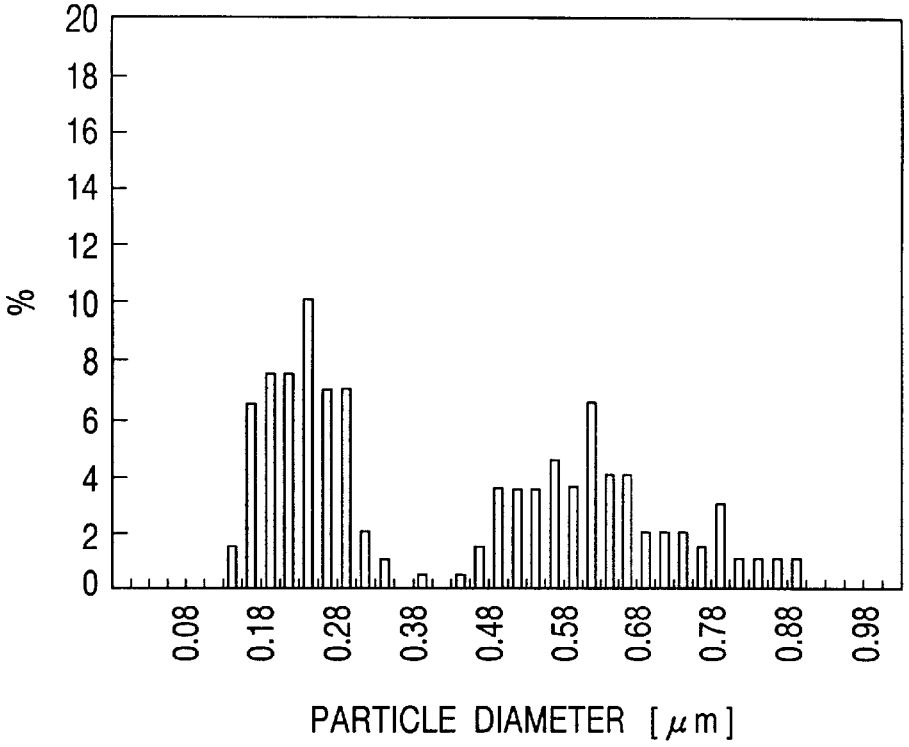
FIG. 8 shows particle size distribution of conductive particles.

Thus, in the present invention, the conductive particles may preferably have at least two peaks or shoulders in their particle size distribution (FIG. 8). This is because the conductive particles having larger particle diameters more readily come to the surfaces of the magnetic particles and hence more preferred surface irregularities can be formed. As the result, the injection of charges into the surface layer of the photosensitive member can be promoted and more uniform charging can be carried out.

In the present invention, when a particle diameter at the peak on the smaller particle diameter side is regarded as r1 and that at the peak on the larger particle diameter side as r2, the conductive particles may also have a value of r2/r1 of from 1.2 to 5.0. This is preferable in order to enhance the strength of the magnetic particles. This is also because conductive particles having larger particle diameters more readily come to the surfaces of the magnetic particles. The r1 may preferably be from 0.02 to 2 μm, and the r2 may preferably be from 0.5 to 5 μm.

Figure 9:
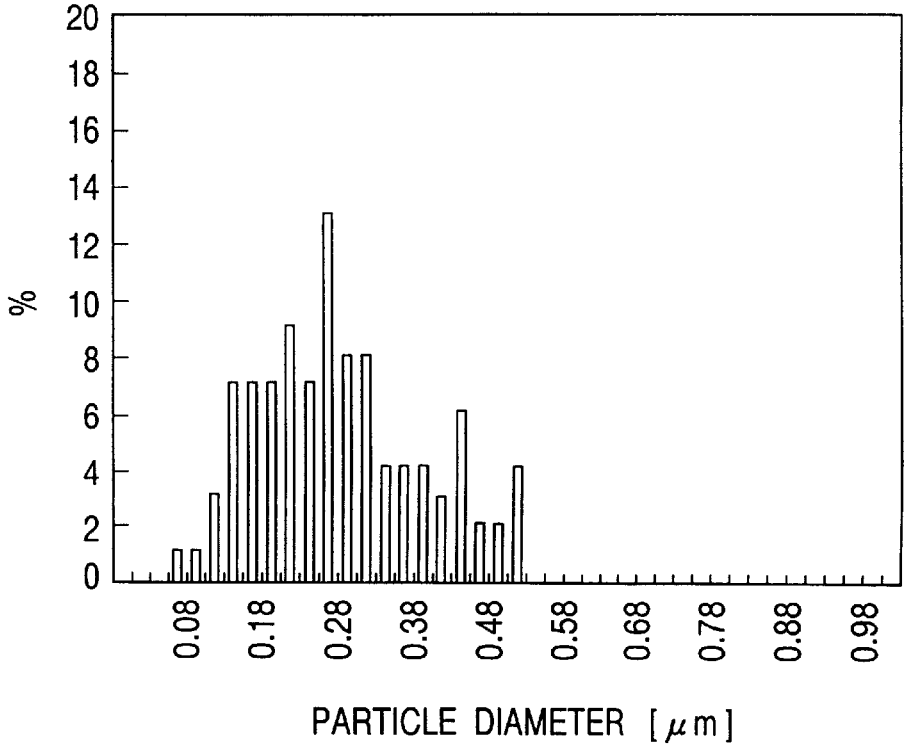
FIG. 9 shows particle size distribution of conductive particles.

The particle size distribution of the conductive particles is determined in the following way. First, using a photographic image of particles which is taken at enlargement of from 5,000 to 20,000 magnifications by means of a scanning electron microscope H-800, manufactured by Hitachi Ltd., at least 300 magnetic particles are sampled at random, and their horizontal-direction Feret's diameters are measured by means of an image processing analyzer LUZEX 3, manufactured by Nireco Co. Next, the diameters (Feret's diameters) are divided at intervals of 0.025 μm and the number of particles in the respective divisions is determined to prepare a graph in which the particle diameters are plotted as abscissa and their proportion with respect to the whole number as ordinate (FIGS. 8 and 9).

As a method of making the conductive particles have at least two peaks or shoulders, it is simple and preferred to use, but not limited to, a method in which two or more types of conductive particles having different average particle diameters are blended.

The peak in the particle size distribution as referred to in the present invention is meant to be a main convex or raised portion characterizing the particle size distribution, and the shoulder is meant to be a portion where a peak is not seen but a point of inflection is present. The peak and shoulder are made clearer by increasing the number of the conductive particles to be measured as to their particle diameter.

The conductive particles may preferably have a resistance value of from $1\times10^{31}$ $^{2}$ Ω·cm to $1\times10^{8}$ Ω·cm, more preferably, from $1\times10^{3}$ Ω·cm to $1\times10^{8}$ Ω·cm. This resistance can be measured by the same method as that for measuring the resistance of the magnetic particles previously described.

The binder resin contained in the composite used in the magnetic particles of the present invention may include phenolic resin and acrylic resin. In view of strength, phenolic resin is preferred which is a thermosetting resin.

In the composite used in the magnetic particles of the present invention, the conductive particles are in a content of from 80% by weight to 99% by weight in total weight based on the total weight of the composite. If their total weight is less than 80% by weight, particles produced may agglomerate one another when the magnetic particles are directly produced by polymerization, and the particle size distribution may become non-uniform, so that no good charging performance can be obtained. If it is more than 99% by weight, the magnetic particles may have a low strength to cause the problems such that the magnetic particles break as a result of running.

The magnetic particles used in the present invention can be produced by a method in which monomers and conductive particles are directly mixed and polymerized (a polymerization method). Here, as the monomers used in the polymerization, phenols and aldehydes may be used in the case of phenolic resins. Stated specifically, phenol and aldehyde are subjected to suspension polymerization in the presence of a basic catalyst in an aqueous medium, with addition of the conductive particles described above and a dispersion stabilizer, to obtain composite particles. As preferred examples of the phenols used here, they may include phenol as well as alkyl phenols such as m-cresol, p-tert-butyl phenol, o-propyl phenol, resorcinol and bisphenol-A. In particular, in view of granulation, cost and so forth, phenol is more preferred.

In the present invention, in order to enhance the strength of the magnetic particles, the binder resin may preferably be used in a cross-linked state. For example, a cross-linking component may be added at the time of melt-kneading to cross-link the binder resin at the time of kneading, or the binder resin may be directly cross-linked at the time of polymerization. Alternatively, monomers incorporated with a cross-linking component may be used.

In the present invention, the surfaces of the magnetic particles may be further coated using a coating agent so long as the effect of the present invention can be obtained. For example, when the magnetic particles to be mixed in the binder resin are selected for the purpose of enhancing the saturation magnetization of the magnetic particles, the magnetic particles can not necessarily have the desired resistance value. In such an instance, their surfaces may be coated using a resistance-controlled coating agent after the magnetic particles have been produced.

The object member used in the present invention may preferably be an electrophotographic photosensitive member. There are no particular limitations on the electrophotographic photosensitive member, except that it must have a charge injection layer as a surface layer when the injection charging is carried out.

The charge injection layer may preferably have a resistance of from $1\times10^{9}$ to $1\times10^{14}$ Ω·cm. The resistance value of the charge injection layer can be measured by a method in which a charge injection layer is formed on a polyethylene terephthalate (PET) film on the surface of which platinum has been vacuum-deposited and a DC voltage of 100 V is applied in an environment of 23° C. and 65% RH to measure its resistance by means of a volume resistance measuring device (4140B pA MATER, manufactured by Hulett Packard Co.).

The lifetime of the photosensitive drum can be prolonged to a certain extent when the charge injection layer is formed in a larger thickness. However, when the charge injection layer is formed in a larger thickness, the charge injection layer formed may act as an electrical resistance layer or a scattering layer to tend to cause a deterioration of photoconductive characteristics of the photosensitive drum or an image deterioration due to scattering of imagewise exposure light. Accordingly, the charge injection layer may preferably be formed in a thickness of from 0.1 to 5μm.

Figure 3:
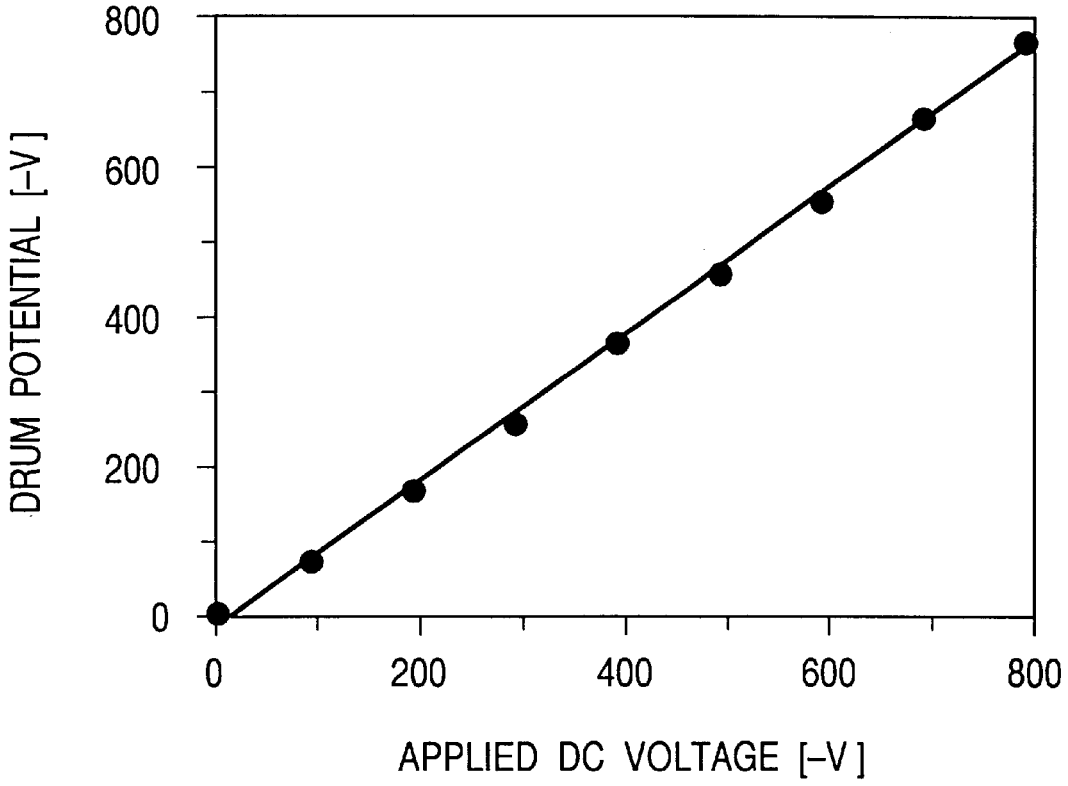
FIG. 3 is a graph showing the charging characteristics of injection charging.

The injection charging is a method in which electric charges are directly injected into the surface layer of the photosensitive member by means of a contact charging member without relying on the phenomenon of discharging. Hence, even when the voltage applied to the charging member is a voltage applied at a value lower than the discharge threshold value, the photosensitive member can be charged to have a potential corresponding to the applied voltage. The relationship between the applied voltage and the photosensitive member surface potential is shown in FIG. 3.

Figure 4:
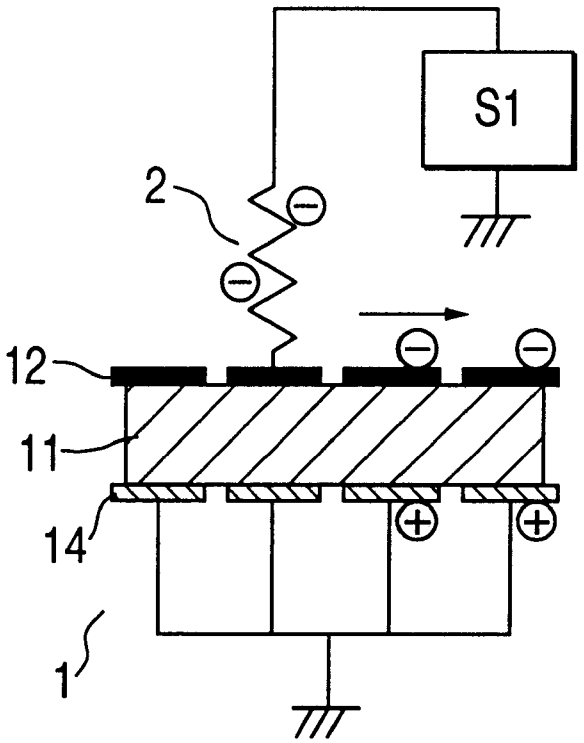
FIG. 4 illustrates a cross section of the electrophotographic apparatus and a concept of the injection charging.
Figure 4:
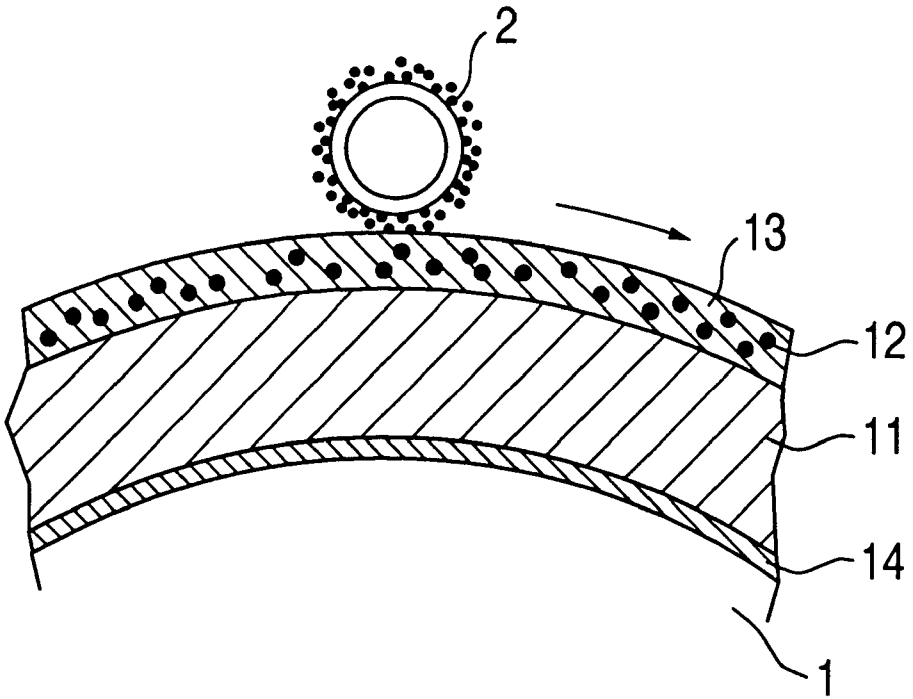

Stated specifically, this is based on the theory that, as shown in FIG. 4, electric charges are supplied to minute capacitors by means of a contact charging member 2, which capacitors are comprised of a dielectric formed by a photosensitive layer 11 and both electrodes formed by an aluminum substrate 14 and conductive particles 12 present in a charge injection layer 13. During this charging, the conductive particles are electrically dependent from each other and form a sort of minute floating electrodes. Hence, It macroscopically appears that the surface of the photosensitive member is supplied with electricity, i.e., charged, to have a uniform potential, but actually the situation is that minute numberless charged $SnO_2$ particles cover the surface of the photosensitive member. Hence, when the surface is subjected to imagewise exposure using a laser, it becomes possible to hold an electrostatic latent image because the individual $SnO_2$ particles are electrically independent.

There are no particular limitations also on the exposure means, developing means and transfer means used in the present invention. The electrophotographic apparatus of the present invention will be described below by giving a specific example.

FIG. 1 schematically illustrates an example of the constitution of the electrophotographic apparatus of the present invention. The electrophotographic apparatus of this example is a laser beam printer.

Reference numeral 1 denotes a drum type electrophotographic photosensitive member serving as the object member. This is hereinafter called photosensitive drum. In this example, the photosensitive drum is a photosensitive drum employing an organic photoconductive material (i.e., an OPC photosensitive drum), having a diameter of 30 mm, and is rotatingly driven in the clockwise direction as shown by an arrow D, at a process speed (peripheral speed) of 100 mm/sec.

Reference numeral 2 denotes a contact charging means employing a conductive magnetic brush brought into touch with the photosensitive drum 1, and is constituted of magnetic particles 23 attracted to a rotatable non-magnetic charging sleeve 21 by the aid of a magnetic force of a charging magnet 22. To this magnetic brush, a DC charging bias of −700 V is applied from a charging bias applying power source S1, so that the periphery of the photosensitive drum 1 is substantially uniformly charged to −700 V by injection charging.

The charged surface of this photosensitive drum 1 is subjected to scanning exposure L made by laser beams outputted from a laser beam scanner (not shown) and intensity-modulated in accordance with time-sequential electrical digital pixel signals of the intended image information, so that an electrostatic latent image corresponding to the intended image information is formed on the surface of the photosensitive drum 1. The electrostatic latent image is developed as a toner image by means of a reversal developing assembly 3 making use of an insulating toner as a magnetic one-component developer. Reference numeral 3*a* denotes a non-magnetic developing sleeve of 16 mm in diameter, internally provided with a magnet 3*b*. The above toner (negative toner) is coated on this developing sleeve, which is then rotated at the same peripheral speed as that of the photosensitive drum 1 in the state that its distance to the surface of the photosensitive drum 1 is set at 300 μm, during which a developing bias is applied to the developing sleeve 3*a* from a developing bias power source S2. As the voltage applied, a voltage obtained by superposing on a DC voltage of −500 V a rectangular AC voltage having a frequency of 1,800 Hz and a peak-to-peak voltage of 1,600 V is applied to cause jumping development to take place between the developing sleeve 3*a* and the photosensitive drum 1.

Meanwhile, a transfer medium P as a recording medium is fed from a paper feed section (not shown), and is guided at a stated timing into a pressure nip portion (transfer portion) T formed between the photosensitive drum 1 and a medium-resistance transfer roller 4 serving as a contact transfer means brought into contact with the former at a stated pressure. To the transfer roller 4, a transfer bias voltage is applied from a transfer bias applying power source S3. In this example, a transfer roller having a resistance value of $5\times10^8$ ohms is used, and a DC voltage of +2,000 V is applied to transfer toner images.

The transfer medium P guided into the transfer portion T is sandwiched at, and transported through, the transfer portion T, and toner images formed and held on the surface of the photosensitive drum 1 are successively transferred by the aid of electrostatic force and pressure.

The transfer medium P on which the toner images have been transferred is separated from the surface of the photosensitive drum 1 and then led into a fixing assembly 5 of, e.g., a heat-fixing system, where the toner images are fixed, and the fixed images are outputted outside the apparatus as an image-formed product (a print or a copy).

After the toner images have been transferred to the transfer medium P, the photosensitive drum surface is cleaned by means of a cleaning assembly 6 to remove contaminants adhering thereto such as residual toner, and is repeatedly used for subsequent image formation.

The electrophotographic apparatus of this example is a cartridge type apparatus in which four processing devices, the photosensitive drum 1, the contact charging means 2, the developing assembly 3 and the cleaning assembly 6, are held in a cartridge 20 so that they are detachable and exchangeable as one unit from the main body of the electrophotographic apparatus, but by no means limited to this type.

The photosensitive drum 1 is an OPC photosensitive member for negative charging, and comprises a drum type support of 30 mm in diameter, made of aluminum, and the following five, first to fifth functional layers provided thereon in order from the lower part.

The first layer is a conductive layer, which is a conductive layer of about 20 μm thick provided in order to level defects and the like of the aluminum drum and also in order to prevent moiré from being caused by the reflection of laser exposure light.

The second layer is a subbing layer, which is a medium-resistance layer of about 1 μm thick playing such a role that the positive charges injected from the aluminum support are prevented from cancelling the negative charges held on the photosensitive drum surface, and whose resistance is controlled to about $10^6$ Ω·cm by Amilan resin and methoxymethylated nylon.

The third layer is a charge generation layer, which is a layer of about 0.3 μm thick formed of a resin with a disazo pigment dispersed therein, and generates positive-negative electron pairs upon exposure to laser light.

The fourth layer is a charge transport layer, which is formed of a polycarbonate resin with hydrazone dispersed therein, and is a p-type semiconductor layer. Hence, the negative charges held on the photosensitive drum surface can not move through this layer and only the charges generated in the charge generation layer can be transported to the photosensitive drum surface.

The fifth layer is the charge injection layer, which is formed of a binder resin and contained therein conductive particles and a lubricant. Stated specifically, 60 parts (parts by weight, the same applies hereinafter) of a photocurable acrylic monomer, 60 parts of ultrafine tin oxide particles doped with antimony to have a low resistance and having an average particle diameter of about 400 angstroms before dispersion, 50 parts of polytetrafluoroethylene having an average particle diameter of 0.18 μm, 20 parts of 2-methylthioxanthone as a photo-initiator and 400 parts of methanol were dispersed by means of a sand mill for 48 hours to obtain a coating dispersion, which was coated by dipping followed by drying. The layer formed was in a thickness of about 2 μm. This layer also had a resistance of $1\times10^{13}$ Ω·cm.

The above example is described with reference to the photosensitive member having on its surface the charge injection layer in which the conductive particles are dispersed. The photosensitive member is not limited thereto, and may be any photosensitive member so long as the energy levels that trap the charges injected into its surface layer are present by the number sufficient for the charging. As examples of such a photosensitive member, it may include photosensitive members comprising amorphous silicon, amorphous selenium or the like.

The magnetic brush as a contact charging member is formed by the magnetic particles 23 attracted to the surface of the rotatable non-magnetic charging sleeve 21 having a diameter of 16 mm by the aid of a magnetic force of a stationary magnet 22.

The magnetic particles that form the magnetic brush in the above example are attracted in a width of 250 mm and in an amount of about 10 g, and the gap between the surface of the charging sleeve 21 and the surface of the photosensitive drum 1 has a minimum value of 500 μm. The magnetic particles are coated on the charging sleeve 21 in a thickness of 1 mm, and a charging nip of about 5 mm wide is formed between the sleeve and the photosensitive drum 1, thus a collection of the magnetic particles is formed at the nip end positioned downstream in the drum rotational direction. The magnetic brush successively comes in touch with the photosensitive drum surface as the charging sleeve 21 is rotated in the direction shown by an arrow E in FIG. 1 (i.e., the direction reverse to the moving direction of the photosensitive drum surface in the charging zone). The ratio of peripheral speed of the magnetic brush to that of the photosensitive drum is calculated by the following expression. Peripheral speed ratio (%)=(magnetic brush peripheral speed−photosensitive drum peripheral speed)/photosensitive drum peripheral speed×100 (the peripheral speed of the magnetic brush is a negative value when it is rotated in the direction reverse to the rotation of the photosensitive drum in the charging zone).

If the peripheral speed ratio is −100%, the magnetic brush is in the state of stop, so that the shape of the magnetic brush appears on the image as it is. Hence, this is not preferable. If the magnetic brush is rotated in the regular order and also comes into touch with the photosensitive drum at a lower speed, the magnetic particles of the magnetic brush tend to adhere to the photosensitive drum. In an attempt to obtain the same peripheral speed ratio as the reverse direction, the magnetic brush must be rotated at a very high number of revolution. Accordingly, the peripheral speed ratio may preferably be less than −100%. In the above example, it was −150%.

Another specific example of the electrophotographic apparatus of the present invention will be described below with reference to FIG. 2.

This example is a system in which the electrophotographic apparatus shown in FIG. 1 has no cleaning means (a cleanerless system). Members denoted by the same reference numerals as those in FIG. 1 are the same members as those shown in FIG. 1.

Figure 2:
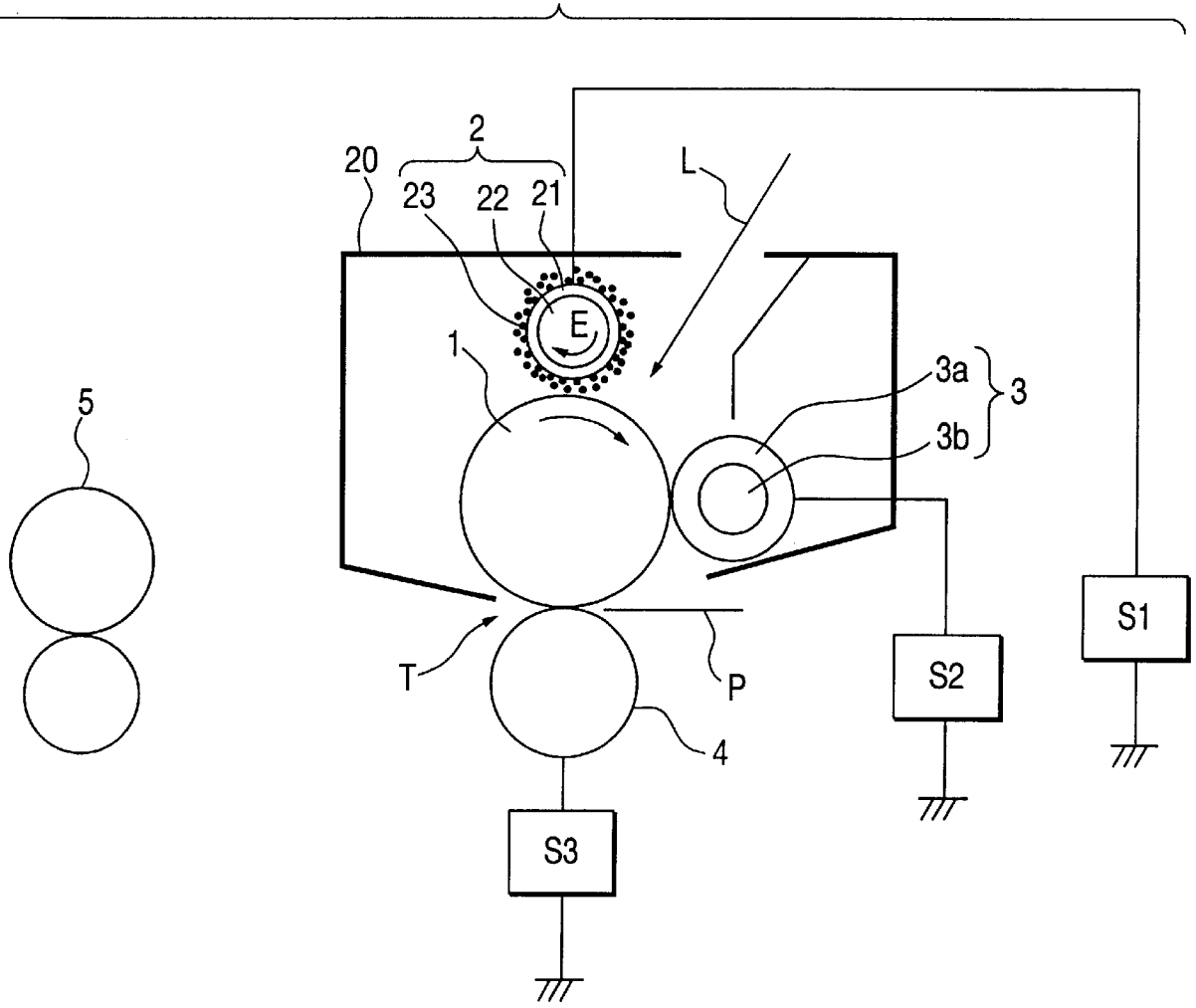
FIG. 2 schematically illustrates another example of the constitution of an electrophotographic apparatus having the charging apparatus of the present invention.

In the apparatus shown in FIG. 2, the toner having remained on the photosensitive drum after transfer is once collected by the magnetic brush formed by the magnetic particles, and is thereafter released therefrom onto the photosensitive drum at an appropriate time. Otherwise, without being collected by the magnetic brush, it slips through the brush as it is, and is finally collected by the developing assembly.

EXAMPLES

The present invention will be described below in greater detail by giving Examples.

Example 1

Magnetic particles for the charging member were produced in the following way.

| | |
|---|---|
| Phenol | 6.5 wt. % |
| Formaldehyde | 3.5 wt. % |

(about 40% of formaldehyde, about 10% of methanol, and the remainder being water)

| | |
|---|---|
| Magnetite | 90 wt. % |

(having peaks at particle diameters 0.24 μm and 0.60 μm (FIG. 8); resistance: $5\times10^5$ Ω·cm)

The above materials, 28% ammonia water as a basic catalyst, calcium fluoride as a polymerization stabilizer and water were put into a flask, and temperature was raised to 85° C. in 40 minutes while stirring and mixing them. Keeping that temperature, the reaction was carried out for 3 hours to effect curing. Thereafter, the reaction mixture was cooled to 30° C., and 0.5 liter of water was added thereto. Thereafter, the supernatant formed was removed, and the precipitate also formed was washed with water, followed by air drying. Subsequently, the resulting particles were further dried at 50 to 60° C. under reduced pressure (5 mmHg or below) to obtain spherical magnetic particles in which the magnetite is combined with phenolic resin as a binder resin. The magnetic particles thus obtained has an average particle diameter of 25 μm, a resistance of $5.0\times10^7$ Ω·cm and a saturation magnetization of 73 ($A\cdot m^2/kg$).

Figure 5:
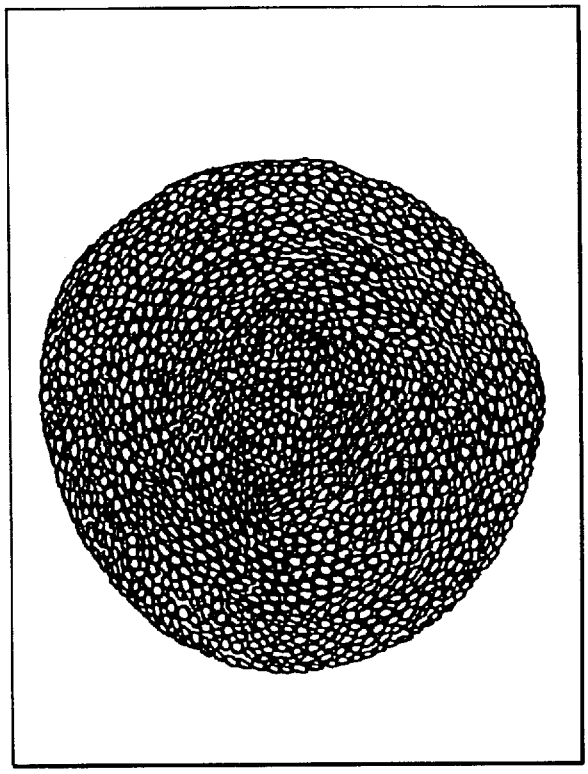
FIG. 5 illustrates an appearance of magnetic particles used in the present invention.

An electron microscope photograph of the magnetic particles produced in the manner as described above was taken. Each particle thereof had the shape as illustrated in FIG. 5. It was macroscopically substantially spherical, and had a sphericity of 1.1. Fine irregularities are seen on its surface.

Using the above magnetic particles in the magnetic brush of the charging means, images were reproduced by means of the electrophotographic apparatus shown in FIG. 1. As a result, since the magnetic particles were macroscopically spherical, they smoothly rolled over the surface of the photosensitive member and the microscopic irregularities present on the surfaces of the magnetic particles enabled smooth and uniform injection of charges into the photosensitive member surface layer. Images were also continuously reproduced on 5,000 sheets, where the magnetic particles were free from breaking which might cause contamination of the photosensitive member surface, and also caused no scratches on the photosensitive member surface because of the shape of particles.

Charging uniformity was evaluated in the following way: An image which is entirely black (whole surface exposure) at its area corresponding to one round of the photosensitive drum and is entirely white at the remaining area was formed to make visual observation on whether or not fog is seen at the white area corresponding to one round of the photosensitive drum. The amount of scrape of the photosensitive drum before and after the image reproduction was also measured using an eddy-current type layer thickness measuring device PERMASCOPE, Type E111, manufactured by Fischer Co.

Results obtained are shown in Table 1.

Example 2

In the present Example, the charging apparatus has a much higher running stability than the charging apparatus described in Example 1.

The procedure of Example 1 was repeated except the following.

In the present Example, two types of magnetic particles were used, having different particle diameters and resistance values.

Stated specifically, magnetic particles (A), the same ones as used in Example 1, were mixed with magnetic particles (B) having a lower resistance and a smaller average particle diameter in an amount of 10% by weight. Magnetic particles (A): average particle diameter of 25 μm, resistance of $5.0\times10^7$ Ω·cm Magnetic particles (B): average particle diameter of 10 μm, resistance of $1.0\times10^4$ Ω·cm The magnetic particles (B) are produced using the same magnetic particles as those of Example 1 except for the average particle diameter, and are made to have a lower resistance by coating phenolic resin in which carbon is dispersed. The coat layers thus formed are so much thin that the magnetic particles has almost no change in their surface properties.

When the charging apparatus having the magnetic brush as used in Example 1 was used over a long period of time, the toner and paper dust having slipped through the cleaning blade mixed in the magnetic brush to tend to cause a lowering of charging performance. This was presumed to be due to the toner and paper dust which had so high resistance that they blocked the conducting path between the magnetic particles of the magnetic brush and the surface of the photosensitive member. Accordingly, in the present Example, the magnetic particles of the present invention, having a lower resistance and a smaller average particle diameter, were mixed in an amount of 10% by weight to make it possible also to ensure the conducting path. Since such particles are mixed with the medium-resistance magnetic particles (A), no leak of charges may also occur even when the photosensitive member surface has faults such as pinholes.

Images were formed using a charging apparatus employing the above magnetic particles in the magnetic brush. As a result, it was possible not only to perform uniform charging without causing contamination or scratches of the photosensitive member, but also to obtain good images while keeping the same charging performance as that at the initial stage even in such a state that toner and paper dust accumulated in the magnetic brush after image reproduction on 5,000 sheets.

Example 3

The procedure of Example 1 was repeated except that the magnetite (average particle diameter: 0.28 $\mu$m) used in the magnetic particles for the charging member were replaced with the one having a particle size distribution as shown in FIG. 9. The apparatus used was the electrophotographic apparatus of the injection charging system as shown in FIG. 1.

The results are shown in Table 1.

Example 4

In the present Example, the same magnetic particles as the charging member magnetic particles used in Example 1 were used.

Images were formed using the cleanerless apparatus previously described with reference to FIG. 2. The photosensitive drum is electrostatically charged by injection charging, and its outermost surface layer is the charge injection layer. The voltage applied to the charging zone is DC voltage of −700 V on which an AC voltage of a peak-to-peak voltage of 800 V and a frequency of 1,000 Hz is superposed. In this Example, some AC voltage is superposed so that the charging magnetic particles can be more active, and hence, stable charging can be carried out over a long period of time even when the cleanerless apparatus is employed.

Comparative Example 1

Magnetic resin particles were used which were prepared by dispersing magnetite and carbon black (for controlling resistance) in polyethylene resin followed by kneading, thereafter cooling, and further followed by pulverization and classification. The magnetic particles thus obtained contained 60% of conductive particles, had a resistance of $6.0\times10^6$ Ω·cm and had an average particle diameter of 25 $\mu$m. The apparatus as shown in FIG. 1 was used.

Figure 6:
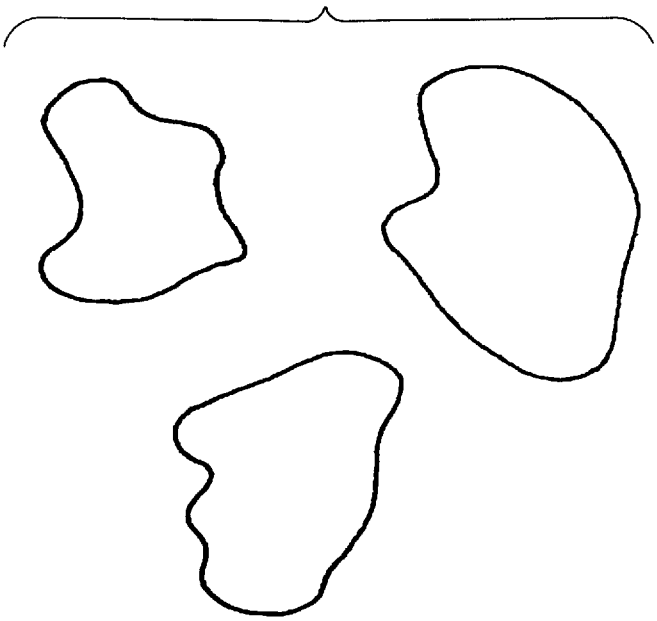
FIG. 6 schematically illustrates magnetic particles obtained by pulverization.

Since the magnetic particles of the present Comparative Example were prepared by pulverization, the particle shape was not macroscopically spherical (FIG. 6), and showed a not good charging uniformity already at the initial stage. The magnetic particles had so weak magnetic properties that they tended to adhere to the photosensitive drum. The magnetic particles were further continuingly used in the apparatus, until the magnetic particles broken to contaminate the surface of the photosensitive drum.

Comparative Example 2

In Comparative Example 1, the polyethylene resin was replaced with phenolic resin. The magnetic particles thus obtained contained 60% of conductive particles, had a resistance of $9.0\times10^6$ Ω·cm and had an average particle diameter of 25 $\mu$m. The magnetic resin particles of the present Comparative Example were very hard and had the shape of pulverized particles, and hence scratched and scraped the surface of the photosensitive drum with ease.

Comparative Example 3

In the present Comparative Example, magnetic particles were prepared using the magnetic particles of Example 3 and carbon black, and contained 60% of conductive particles in total. The magnetic particles obtained here had a resistance of $5.0\times10^6$ Ω·cm and had an average particle diameter of 25 $\mu$m.

Since the conductive particles were mixed in a small amount, the magnetic particle surfaces had less microscopic irregularities, so that, although a good charging performance was exhibited at the initial stage, the magnetic particles deteriorated with a progress of running, resulting in a low charging uniformity.

TABLE 1

| | Charging uniformity | | | Amount of scrape of photosensitive drum surface After 5,000 sheets ($\mu$m) |
|---|---|---|---|---|
| | Initial stage | After 1,000 sheets | After 5,000 sheets | |
| Example: | | | | |
| 1 | AA | AA | A | 0.2 |
| 2 | AA | AA | AA | 0.2 |
| 3 | AA | A | A | 0.4 |
| 4 | AA | A | A | 0.3 |
| Comparative Example: | | | | |
| 1 | B | B | C | *1 |
| 2 | B | B | C | 3.5 |
| 3 | A | B | C | 0.6 |

*1 Photosensitive drum surface contaminated
AA: Excellent
A: Good
B: Passable
C: Failure

What is claimed is:

1. A charging apparatus comprising an object member and a charging member comprised of magnetic particles, provided in contact with the object member and capable of electrostatically charging the object member upon application of a voltage;

the surfaces of said magnetic particles being formed of a composite comprising conductive particles and a binder resin, and the conductive particles being in a proportion from 80% by weight to 99% by weight in total weight based on the weight of the composite, wherein said conductive particles have a particle size distribution having at least two peaks or shoulders.

2. The charging apparatus according to claim 1, wherein said magnetic particles have a resistance value of from $1\times10^5$ Ω·cm to $1\times10^8$ Ω·cm.

3. The charging apparatus according to claim 1, wherein said magnetic particles have a sphericity of 2 or less.

4. The charging apparatus according to claim 1, wherein particle diameter r1 at the peak or shoulder on the smaller particle diameter side and particle diameter r2 at the peak or shoulder on the larger particle diameter side satisfy the following expression:

$$1.2 \leqq (r2/r1) \leqq 5.0.$$

5. The charging apparatus according to claim 1, wherein said conductive particles have a resistance value of from $1\times10^{-2}$ Ω·cm to $1\times10^{8}$ Ω·cm.

6. The charging apparatus according to claim 1, wherein said magnetic particles are formed by polymerization.

7. The charging apparatus according to claim 1, wherein said object member is an electrophotographic photosensitive member.

8. The charging apparatus according to claim 7, wherein said electrophotographic photosensitive member has a charge injection layer as a surface layer.

9. The charging apparatus according to claim 8, wherein said charge injection layer has a resistance value of from $1\times10^{9}$ Ω·cm to $1\times10^{14}$ Ω·cm.

10. The charging apparatus according to claim 1, wherein said conductive particles are formed from a metal, an alloy or a metal oxide, having magnetism.

11. The charging apparatus according to claim 10, wherein said conductive particles have particle size distribution having at least two peaks or shoulders.

12. The charging apparatus according to claim 11, wherein said binder resin is a thermosetting resin.

13. An electrophotographic apparatus comprising an electrophotographic photosensitive member, a charging member comprised of magnetic particles, provided in contact with the electrophotographic photosensitive member and capable of electrostatically charging the electrophotographic photosensitive member upon application of a voltage, an exposure means, a developing means, and a transfer means;

the surfaces of said magnetic particles being formed of a composite comprising conductive particles and a binder resin, and the conductive particles being in a proportion from 80% by weight to 99% by weight in total weight based on the weight of the composite, wherein said conductive particles have a particle size distribution having at least two peaks or shoulders.

14. The electrophotographic apparatus according to claim 13, wherein said magnetic particles have a resistance value of from $1\times10^{5}$ Ω·cm to $1\times10^{8}$ Ω·cm.

15. The electrophotographic apparatus according to claim 13, wherein said magnetic particles have a sphericity of 2 or less.

16. The electrophotographic apparatus according to claim 13, wherein particle diameter r1 at the peak or shoulder on the smaller particle diameter side and particle diameter r2 at the peak or shoulder on the larger particle diameter side satisfy the following expression:

$$1.2 \leqq (r2/r1) \leqq 5.0.$$

17. The electrophotographic apparatus according to claim 13, wherein said conductive particles have a resistance value of from $1\times10^{-2}$ Ω·cm to $1\times10^{8}$ Ω·cm.

18. The electrophotographic apparatus according to claim 13, wherein said magnetic particles are formed by polymerization.

19. The electrophotographic apparatus according to claim 13, wherein said electrophotographic photosensitive member has a charge injection layer as a surface layer.

20. The electrophotographic apparatus according to claim 19, wherein said charge injection layer has a resistance value of from $1\times10^{9}$ Ω·cm to $1\times10^{14}$ Ω·cm.

21. The electrophotographic apparatus according to claim 13, wherein said conductive particles are formed from a metal, an alloy or a metal oxide, having magnetism.

22. The electrophotographic apparatus according to claim 21, wherein said conductive particles have particle size distribution having at least two peaks or shoulders.

23. The electrophotographic apparatus according to claim 22, wherein said binder resin is a thermosetting resin.

24. The electrophotographic apparatus according to claim 13, wherein said developing means is substantially a cleaning means.

* * * * *

UNITED STATES PATENT AND TRADEMARK OFFICE

CERTIFICATE OF CORRECTION

PATENT NO. : 5,930,566

DATED : July 27, 1999

INVENTOR(S) : Harumi Ishiyama

It is certified that error appears in the above-identified patent and that said Letters Patent is hereby corrected as shown below:

COLUMN 7

Line 4, "$1x10^{31\ 2}$" should read --$1x10^{-2}$--; and
Line 17, "one" should read --to one--.

COLUMN 8

Line 4, "Hulett" should read --Hewlett--.

COLUMN 11

Line 19, "revolution" should read --revolutions--.

COLUMN 14

Line 3, "broken" should read --broke down--.

Signed and Sealed this
First Day of February, 2000

*Attest:*

*Attesting Officer*

Q. TODD DICKINSON

*Acting Commissioner of Patents and Trademarks*